United States Patent [19]

Gartshore

[11] Patent Number: 4,903,383

[45] Date of Patent: Feb. 27, 1990

[54] ANTI-THEFT FASTENING

[75] Inventor: Brian I. Gartshore, Leicester, United Kingdom

[73] Assignee: ID Systems International BV, Zwolle, Netherlands

[21] Appl. No.: 169,812

[22] Filed: Mar. 18, 1988

[51] Int. Cl.[4] ..... G08B 13/14

[52] U.S. Cl. ..... 24/706.8; 24/706.6; 340/572

[58] Field of Search ..... 24/155 BR, 150 R, 155 R, 24/108, 602, 651, 662, 677, 696; 340/572

[56] References Cited

U.S. PATENT DOCUMENTS

| | | | |
|---|---|---|---|
| 3,858,280 | 1/1975 | Martens | 24/155 BR X |
| 3,911,534 | 10/1975 | Martens et al. | 340/572 X |
| 4,195,391 | 4/1980 | Anderson | 24/155 BR |
| 4,280,256 | 7/1981 | de Jong | 24/155 BR |
| 4,339,853 | 7/1982 | Lipschitz | 24/155 BR |
| 4,531,264 | 7/1985 | Minasy | 24/155 BR |
| 4,590,461 | 5/1986 | Cooper | 340/572 |

*Primary Examiner*—Laurie K. Cranmer
*Attorney, Agent, or Firm*—Spensley Horn Jubas & Lubitz

[57] ABSTRACT

An anti-theft tag has releasably connected male and female portions. The male portion is in the form of a pin. The female portion has a retainer and an insert loosely received in a housing. The insert has a cup-shaped recess facing the retainer with a generally conical sidewall tapering outwardly towards the retainer. The insert and retainer have coaxial bores which receive the shank of the pin. Four retaining balls are received in the insert recess and are urged into tight frictional engagement with the pin shank by the retainer which is biased towards the insert by a coil spring. Once the pin is engaged in the insert and retainer bores it is held by the retaining balls and cannot be removed except by use of a special tool. The floating insert prevents by preventing unauthorized removal of the pin separation of the insert and retainer as a result of a sharp tap to the housing.

7 Claims, 1 Drawing Sheet

ANTI-THEFT FASTENING

BACKGROUND OF THE INVENTION

The present invention relates to an anti-theft fastening for articles of merchandise for use with article surveillance or identification tagging.

Goods on sale in retail outlets such as department stores generally carry anti-theft tags which must be removed from purchased articles at the point of sale. If an attempt is made to remove an article from a store without the tag being removed, the tag, which contains electrical circuitry, triggers an alarm system at an exit of the store.

An anti-theft tag must meet certain requirements. It must be inexpensive, must not be susceptible to removal by a would-be shoplifter whilst being easily removable at a point of sale counter with a special tool, and should not damage any article during attachment and removal of the tag to and from the article. This is particularly important with clothing which is susceptible to damage.

U.S. Pat. No. 3,911,534 describes one form of fastening clip for articles of clothing. The clip has a pin which passes through the fabric of the article and is clamped in a female component, the fabric of the article being secured between the pin head and the female components. The female component has retaining balls which are loosely received in lateral bores in a retainer which in turn is slidably received in a housing. The retainer is biased towards the pinhead by a spring such that the balls contact a frusto-conical inner surface of a ring rigidly secured in the housing and are urged against the pin shank, gripping the latter and preventing withdrawal of the pin. Release of the pin is effected by drawing the retainer away from the pin head using a special tool, thus releasing the balls and the pin shank.

Whilst fastening clips such as the above-described clip are relatively inexpensive and do not damage the article material, they do suffer from a severe disadvantage. It has proved easy to disengage the pin from the female component, for example by giving the end of the female component remote from the pin head a sharp rap. Although this projects the housing towards the pin head, the inertia of the retaining balls and the retainer momentarily result in these being displaced relative to the housing away from the pin head, releasing the grip on the pin shank and allowing the pin to disengage from the female component.

SUMMARY OF THE INVENTION

The present invention seeks to provide an improved anti-theft fastening.

The present invention provides an anti-theft fastening comprising:

a housing;

a retainer loosely received within said housing and having an axial bore therein;

an insert loosely received within said housing and having a cup-shaped recess facing said retainer, said recess having a generally conical side wall tapering outwardly towards said retainer and said member having a central bore coaxial with said retainer bore;

a plurality of retaining balls located in said cup-shaped recess between said insert and said retainer;

pin means for extending through said central bore and into said axial bore of said retainer; and resilient means for resiliently biasing said retainer towards said insert thereby causing said retaining balls to engage tightly and frictionally against said pin means when inserted into said bores and retain said pin means in said bores.

In a preferred form of the invention the pin means is a pin whose shank has reduced diameter portions for engaging the retaining balls.

The preferred form of the invention provides a fastening which can be quickly and easily secured to articles and only removed by means of a special tool.

Any attempt at unauthorized removal of the tag, by:

(a) Applying pressure—only serves to increase security by increasing the resistance to separation of the pin and housing, (b) Sharp impact—has no effect, unlike hitherto known fastenings in which the pin is momentarily released, and security is impaired, (c) Pin rotation—only serves to rotate the balls around the pin reduced diameter portions and not along the pin shaft.

This fastening can be used as an integral part of an identification or anti-theft tag or separately by securing both the article and the anti-theft tag at the same time.

DETAILED DESCRIPTION OF THE PREFERRED EMBODIMENT

Figure 1:
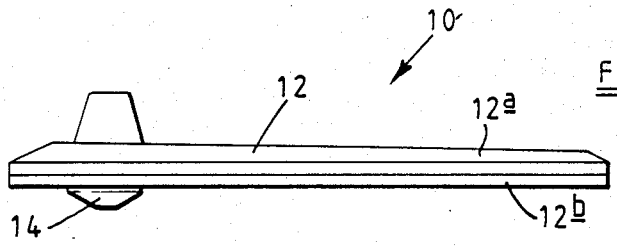
FIG. 1 is a side elevation of an anti-theft tag incorporating a preferred form of anti-theft fastening according to the present invention.
Figure 2:
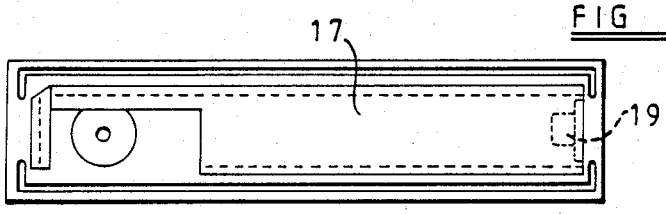
FIG. 2 is a plan view of the lower portion of the tag of FIG. 1.
Figure 3:
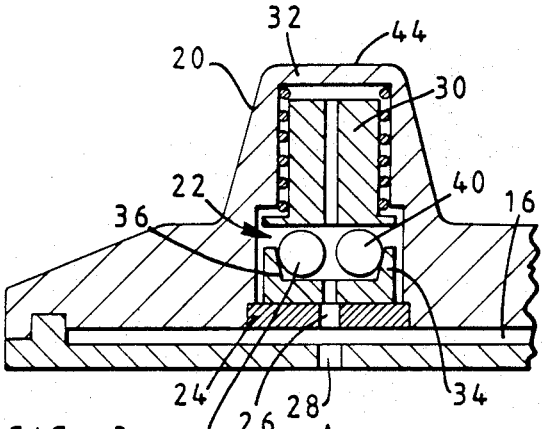
FIG. 3 is a partial section through the tag of FIG. 1 along the longitudinal axis of the tag.

Referring now to the drawings, wherein like parts are indicated by like reference numerals, FIGS. 1 to 3 show an anti-theft tag 10 incorporating an anti-theft fastening which comprises a female portion 12 and a male portion 14 which is in the form of a pin having a pointed shank 16 and an enlarged head 18. The shank of the pin can be passed through an article to which the tag is to be temporarily secured and inserted and retained in the female portion 12.

The female portion 12 comprises two generally planar parts **12*a*, 12*b* which are made of non-metallic material such as plastics material and are ultrasonically welded together generally along their periphery to retain between the two parts an electrical circuit 17 which in the illustrated example includes a diode 19. If an attempt is made to remove from a store an article to which the tag is attached, the circuit 17** will detect a signal from an alarm system at the store outlet and re-radiate an alarm signal.

Referring now to FIG. 3, one end region of the part **12*a* of the female portion 12 is formed with a dome-like or conical extension or "bulge" 20 which forms a housing of the fastening with a generally cylindrical interior 22. The axis of the cylindrical interior 22 lies at right angles to the plane of the female portion 12 and is closed, at its end facing the portion 12*b*, by a closure member or disc 24. The disc 24 has a central bore 26 which is in register with a corresponding bore 28 in the portion 12*b* to allow passage of the pin shank 16**.

A generally cylindrical retainer 30 is loosely received within the interior 22 and is urged towards the disc 24 by means of a coil spring 32. A cup-shaped member 34 is also loosely received within the interior 22 between the retainer 30 and disc 24 with the interior of the member 34 facing the retainer 30.

The interior of the cup-shaped member 34 has a generally conical side wall 36 which tapers outwardly towards the retainer 30. Two, three, four or more retaining balls 38, 40 are received in the cup-shaped member 34. The latter and retainer 30 have co-axial bores in line with the bores 26 and 28 to receive the pin shank 16.

In use, the retainer 30 is urged,downwardly as seen in FIG. 3 by the coil spring 32 to retain the balls 38, 40 at the bottom of the cup-shaped member 34 where these balls grip the shank 16 of the pin 14 when the shank is inserted into the bores. During insertion of the pin shank 16, the latter contacts the retaining balls 38, 40 and since these cannot move transversely within the cup-shaped member 34 they ride up the side wall of the member 34 against the retainer 30 and allow penetration of the pin shank 16. When the pin is fully inserted, the spring 32 biases the retainer 30 downwardly, forcing the retaining balls 38, 40 into tight frictional engagement with the shank 16 to prevent removal of the pin.

The retainer 30 may have a domed or conical end face facing the balls 38,40 to urge them into tigher contact with the side wall of the member 34. The angle of the dome or cone face may be in the range 0° to 20° to the horizontal and is preferably 10°.

One or more peripheral grooves 42 may be provided in the shank 16 to receive the retaining balls 38, 40 and assist in preventing removal of the pin by rotating the pin and "unscrewing" the pin from the bores.

Any unauthorized attempts to withdraw the pin result in increased frictional action by the retaining balls 38, 40 due to the wedge action of the interior wall of the cup-shaped member 34 and pressure of the retainer 30.

Authorised removal of the pin is effected by placing a magnet or electromagnetic tool against or around to the outer end 44 of the extension 20. This draws the retainer 30 away from the cup-shaped member 34, releasing the retaining balls 38,40 and allowing withdrawal of the pin. The retainer 30 is made of magnetic material such as steel or, for example, of plastics material impregnated with magnetic material.

An attempt to effect unauthorized removal of the pin 14 by giving the extension 20 a sharp rap at its end 44 would, by virtue of the inertia of the retainer 30, cause the latter to float towards the end 44. If the cup-shaped member 34 were rigidly secured relative to the female portion **12*a* then this would release the retaining balls 38 and 40 and allow withdrawal of the pin 14. However, since the cup-shaped member 34 is, like the retainer 30, loosely received in the interior 22, the inertia of the member 34 also results in its floating momentarily towards the end 44 with the retainer 30. The retaining balls 38,40 are therefore maintained in tight engagement with the pin shank 16** preventing withdrawal of the pin.

Figure 4:
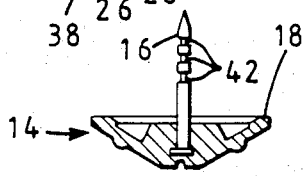
FIG. 4 is a section through a housing for a separate anti-theft fastening.
Figure 4:
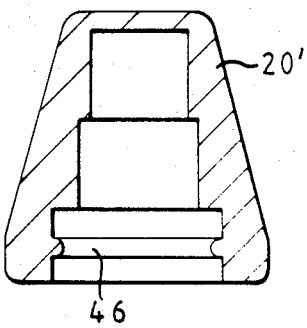

FIG. 4 is a vertical section through a housing 20' for a discrete anti-theft fastening i.e. a fastening which is not an integral part of an anti-theft tag such as shown in FIGS. 1 to 3. The interior of the housing 20' is similar to that of the extension 20 of the tag of FIG. 1 and receives a retainer 30, cup-shaped member 34 and retaining balls 38,40 in the same manner as the tag shown in FIGS. 1 to 3, the retainer being spring biased by a coil spring 32. These are omitted from FIG. 4 for clarity.

The open end of the housing 20' has a peripheral rib 46 which engages in a corresponding groove in a closure member similar to disc 24, the closure member being a snap-fit in the open end of the housing 20'. Alternatively, the closure member can be formed with the peripheral rib and the rib 46 replaced by a co-operating groove. The action of the fastening of FIG. 4 is exactly the same as the fastening of FIG. 3.

Finally, the cup-shaped member 34 may be in the form of a ring with a tapering inner wall.

I claim:

1. An anti-theft fastening comprising:

a housing;

a retainer loosely received within said housing for axial movement therein along a first distance and having an axial bore therein;

an insert loosely received within said housing for axial movement with said retainer along a second distance and having a cup-shaped recess facing said retainer, said recess having a generally conical side wall tapering outwardly towards said retainer and said insert having a central bore coaxial with said retainer bore, the first distance being not greater than the second distance;

a plurality of retaining balls located in said cup-shaped recess between said insert and said retainer;

pin means for extending through said central bore and into said axial bore of said retainer;

resilient means for resiliently biasing said retainer towards said insert thereby causing said retaining balls to engage tightly and frictionally against said pin means when inserted into said bores and retain said pin means in said bores;

whereby tight engagement between said retaining balls and said pin means is maintained during axial movement of said insert with said retainer to thereby prevent withdrawal of said pin means by sharp impact upon said housing.

2. An anti-theft fastening according to claim 1 wherein said retainer is made of magnetic material.

3. An anti-theft fastening according to claim 1 wherein said retainer is made of plastics material impregnated with magnetic material.

4. An anti-theft fastening according to claim 1 wherein said pin means has a shank for engagement in said bores, said shank having a reduced diameter portion for engagement with said retaining balls.

5. An anti-theft fastening according to claim 1 wherein said housing has a generally cylindrical interior and said retainer and said insert are generally cylindrical in shape.

6. An anti-theft fastening according to claim 1 having four said retaining balls.

7. An anti-theft fastening according to claim 1 further comprising self-aligning means for self-aligning said retainer and said insert to thereby facilitate passage of said pin means.

* * * * *